US006860792B2

(12) United States Patent
Krondorfer et al.

(10) Patent No.: US 6,860,792 B2
(45) Date of Patent: Mar. 1, 2005

(54) HAND TOOL COMPRISING A SENSOR FOR EMITTING A SIGNAL WHEN THE TOOL ATTACHMENT IS REPLACED

(75) Inventors: Harald Krondorfer, Ludwigsburg (DE); Markus Heckmann, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 15 days.

(21) Appl. No.: 10/182,513

(22) PCT Filed: Oct. 26, 2001

(86) PCT No.: PCT/DE01/04064

§ 371 (c)(1),
(2), (4) Date: Oct. 8, 2002

(87) PCT Pub. No.: WO02/43920

PCT Pub. Date: Jun. 6, 2002

(65) Prior Publication Data

US 2003/0176147 A1 Sep. 18, 2003

(30) Foreign Application Priority Data

Dec. 1, 2001 (DE) ..... 100 59 712

(51) Int. Cl.[7] ..... B24B 49/00
(52) U.S. Cl. ..... 451/8; 451/344; 451/359
(58) Field of Search ..... 451/6, 8, 353, 451/359, 344, 342, 352, 354, 357, 350, 358

(56) References Cited

U.S. PATENT DOCUMENTS

| | | | | | |
|---|---|---|---|---|---|
| 4,830,549 | A | * | 5/1989 | Neumaier et al. | 408/9 |
| 5,601,483 | A | * | 2/1997 | Rudolf et al. | 451/359 |
| 5,718,621 | A | * | 2/1998 | Turley | 451/342 |
| 6,511,369 | B2 | * | 1/2003 | Chi | 451/344 |

FOREIGN PATENT DOCUMENTS

| | | |
|---|---|---|
| DE | 35 33 090 A | 3/1987 |
| DE | 43 05 967 A1 | 9/1994 |
| DE | 43 36 620 A1 | 5/1995 |
| DE | 195 02 286 A1 | 8/1996 |
| DE | 196 12 246 A | 9/1997 |
| DE | 297 19 020 U1 | 1/1998 |
| EP | 0 904 896 A2 | 3/1999 |

* cited by examiner

*Primary Examiner*—Dung Van Nguyen
(74) *Attorney, Agent, or Firm*—Michael J. Striker

(57) ABSTRACT

The invention is based on a hand power tool, in particular a manually operated right angle grinding machine or a manual circular saw, with a driver mechanism (12), which can operatively connect an inserted tool (16) to a drive shaft (18).

The invention proposes that at least one sensor (10) can detect at least one procedural step in the changing of an inserted tool (16) and can produce a signal.

9 Claims, 2 Drawing Sheets

HAND TOOL COMPRISING A SENSOR FOR EMITTING A SIGNAL WHEN THE TOOL ATTACHMENT IS REPLACED

BACKGROUND OF THE INVENTION

The invention is based on hand power tool.

In order to be able to advantageously connect an inserted tool to a drive shaft of a machine tool by means of a tool holding fixture, it is known to affix the drive shaft to a locking device.

For right angle grinders, a locking device is known that has a locking bolt, which is guided in a housing so that it is rotationally fixed in relation to the drive shaft and which, by means of an actuating button, can be brought into engagement with a gearing that is non-rotatably connected to the drive shaft.

In addition, EP 0 904 896 A2 has disclosed a grinding machine tool holding fixture for a manually operated right angle grinding machine. The right angle grinding machine has a drive shaft, which has a thread oriented toward the tool.

The grinding machine tool holding fixture has a driver and a retaining nut. In order to install a grinding wheel, the driver is slid with a mounting opening onto a collar of the drive shaft and by means of the retaining nut, is clamped in a frictionally engaging manner to a supporting surface of the drive shaft. Oriented toward the tool and extending in the axial direction, the driver has a collar that has recesses on its outer circumference, on two radially opposing sides, which extend axially to a base of the collar. A groove extends on the outer circumference of the collar, counter to the drive direction of the drive shaft, starting from each of the recesses. The grooves are closed counter to the drive direction of the drive shaft and taper axially starting from the recesses, counter to the drive direction of the drive shaft.

The grinding wheel has a hub with a mounting opening, which contains two opposing tabs pointing radially inward. The tabs can be inserted axially into the recesses and then introduced circumferentially into the grooves, counter to the drive direction. By means of the tabs in the grooves, the grinding wheel is fixed in a form-fitting manner in the axial direction and is fixed in a frictionally-engaging manner by the tapering contour of the grooves. During operation, the frictional engagement increases due to the reaction forces acting on the grinding wheel, which act counter to the drive direction.

In order to prevent the grinding wheel from coming off when the driver is braking the drive shaft, in the vicinity of a recess on the circumference of the collar, a stopper is provided, which is supported so that it can move in the axial direction in an opening. In an operating position with the grinding wheel pointing downward, the stopper is axially deflected toward the grinding wheel by the force of gravity, closes the groove in the direction of the recess, and prevents the tabs disposed in the groove from moving in the drive direction of the drive shaft.

SUMMARY OF THE INVENTION

The invention is based on hand power tool, in particular a manually operated right angle grinding machine or a manual circular saw, with a driver mechanism, which can operatively connect an inserted tool to a drive shaft.

The invention proposes that at least one sensor, which is disposed in particular in the vicinity of the driver mechanism, can detect at least one procedural step in the changing of an inserted tool and can produce a signal. An operation of the hand power tool can be prevented while the inserted tool is being changed and the safety can be increased particularly by virtue of the fact that the signal can prevent an operation of the driver mechanism. A wide variety of sensors deemed appropriate by one skilled in the art can be used for the embodiment according to the invention, such as electrical, mechanical, and/or electromechanical sensors, etc., which can produce a variety of signals, such as electrical, mechanical, optical, and/or acoustic signals, etc.

Furthermore, preventing the driver mechanism from operating can be achieved by variety of structural embodiments, for example by means of a mechanical and/or electromechanical clutch, which can be combined with a locking device of a drive shaft. If the signal can interrupt a power supply, for example by means of an electrical sensor and a switch, then this allows the operation to be prevented with a particularly space-saving and lightweight design.

It can also be advantageous if a light source can be switched by means of the signal, for example a warning light, which notifies an operator of a change, or a change that has not yet been completed, and/or an illumination of the driver mechanism, which can facilitate an installation and removal of an inserted tool in dark spaces.

In another embodiment, the invention proposes that the inserted tool can be operatively connected to the driver mechanism by means of at least one detent element, which is supported so that it can move in opposition to a spring element and which engages in an operating position of the inserted tool and fixes the inserted tool in a form-fitting manner, and that the sensor can detect at least one position of the detent element. The form-fitting engagement can achieve a high degree of safety and can produce a simple and inexpensive tool-free quick-clamping system and the sensor can be easily integrated into it. The movement of the detent element can be detected directly or indirectly by means of a component moved by the detent element. The inserted tool can be reliably prevented from unintentionally coming loose by means of the form-fitting engagement, even when the drive shaft is being braked, during which intense braking moments can occur. Fundamentally, however, it is also conceivable that the sensor is actuated by means of a cable control and/or a lever mechanism, etc.

The movable support of the detent element permits a large deflection of the detent element during installation of the inserted tool, which permits a large amount of overlap between two corresponding detent elements and a particularly secure form-fitting engagement to be produced and on the other hand, permits an easily audible engagement sound to be produced, which advantageously indicates to the operator that the desired locking procedure has been completed.

The movably supported detent element can be embodied in a variety of forms deemed appropriate by one skilled in the art, for example an opening, projection, pin, bolt, etc., and can be disposed on the inserted tool or on the driver mechanism. The detent element itself can be movably supported in a component in a bearing, for example in a flange of the driver mechanism or in a tool hub of the inserted tool. The detent element, however, can also be embodied as connected by means of frictional engagement, form-fitting engagement, and/or materially adhesive engagement to a component movably supported in a bearing or can be of one piece with this component, for example a component supported on the drive shaft or to a tool hub of the inserted tool.

Furthermore, the form-fitting engagement permits an advantageous encoding to be achieved so that only specifically intended inserted tools can be fastened in the driver mechanism. The driver mechanism can be at least partially embodied as a detachable adapter piece or can be detachably connected to the drive shaft by means of frictional engagement, form-fitting engagement, and/or materially adhesive engagement.

The detent element can be embodied so that it can move in various directions in opposition to a spring element, for example in the circumference direction or in a particularly advantageous manner, in the axial direction, which permits the achievement of a structurally simple embodiment and a movement path that can be easily detected by the sensor.

A particularly inexpensive, rugged, and structurally simple embodiment can also be achieved in that the detent element can actuate an electrical switch element that constitutes the sensor. If the switch element is disposed so that it cannot rotate in relation to a rotation axis of the drive shaft or is affixed to the housing, then an additional rotating mass and an expensive set of contact connections between components that rotate in relation to each other can be avoided. At the very least, however, individual pieces can also be embodied so that they rotate, for example in the vicinity of an actuating button.

In another embodiment, the invention proposes that the drive shaft can be locked by means of an actuating button of a locking device in order to change the inserted tool and that the sensor can detect a position of the actuating button. Additional components can be saved and a reliable signal can be achieved. Fundamentally, however, it is also conceivable for the signal be able to lock the drive shaft electrically and/or electromagnetically, etc.

The invention also proposes that the actuating button is operatively connected to the drive shaft in the rotation direction and the actuating button for locking the drive shaft can connect at least one first part, which is operatively connected to the drive shaft in the rotation direction, to a second part that cannot rotate in relation to a rotation axis of the drive shaft. Having the actuating button rotate with the drive shaft during operation can reliably prevent the actuating button from being improperly used to slow down the drive shaft. A detachment of inserted tool due to an unforeseen, powerful braking moment and an associated injury risk can be reliably prevented and wear on the locking device can be reduced.

The embodiment according to the invention can be used in a variety of hand power tools deemed appropriate by one skilled in the art, for example eccentric grinders, oscillating grinders, brushes, drills, etc., but can be used to particular advantage in manual circular saws and right angle grinders in which uncontrollably rotating inserted tools can cause particularly serious injuries.

BRIEF DESCRIPTION OF THE DRAWINGS

Other advantages ensue from the following description of the drawings. An exemplary embodiment of the invention is shown in the drawings. The drawings, the specification, and the claims contain numerous features in combination. One skilled in the art will also suitably consider the features individually and will unite them to form other meaningful combinations.

DESCRIPTION OF THE PREFERRED EMBODIMENT

Figure 1:
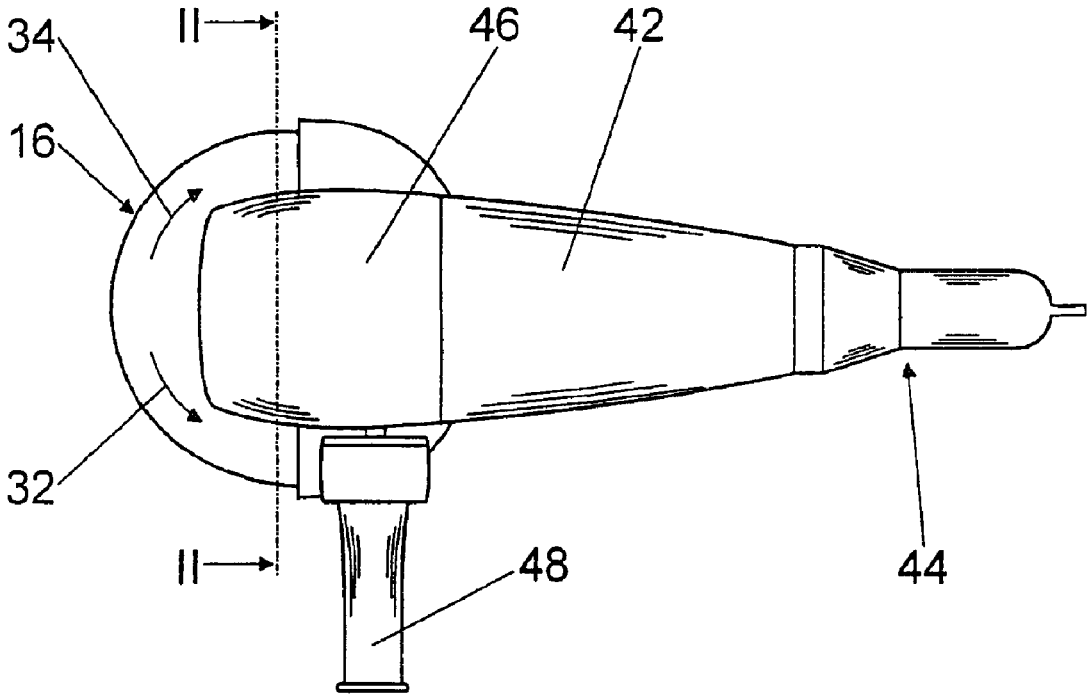
FIG. 1 shows a top view of a right angle grinder.

FIG. 1 shows a top view of a right angle grinding machine with an electric motor, not shown, contained in a housing 42. The right angle grinding machine can be guided by means of a first handle 44 extending the longitudinal direction and integrated into the housing 42 on the side remote from a cutting wheel 16 and by means of a second handle 48 extending lateral to the longitudinal direction and fastened to the transmission housing 42 in the vicinity of the cutting wheel 16.

Figure 2:
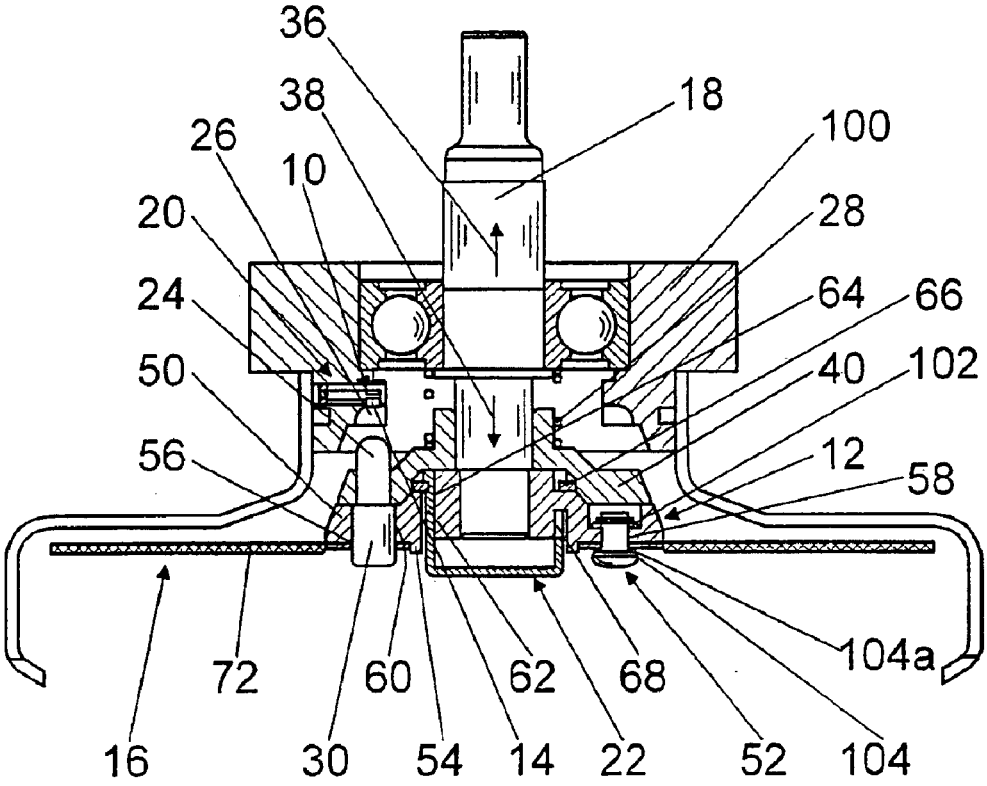
FIG. 2 shows a schematic cross section along the line II—II in FIG. 1, through a grinding machine tool holding fixture according to the invention.

By means of a transmission that is not shown in detail, the electric motor can drive a drive shaft 18, whose end oriented toward the cutting wheel 16 is provided with a driver mechanism 12 (FIG. 2). On a side oriented toward the cutting wheel 16, the driver mechanism 12 has a driver a flange 50 press-fitted onto the drive shaft 18 and on a side oriented away from the cutting wheel 16, has a driver disk 40, which is supported so that it can be slid on the drive shaft 18 in opposition to a concentrically disposed helical spring 28.

Furthermore, three pins 52, which extend up from the supporting surface 56 in the axial direction 38 and are evenly distributed in the circumference direction 32, 34, are provided for axially fixing the cutting wheel 16 in the axial direction 38 in relation to a respective disk spring 102. At their ends oriented toward the cutting wheel 16, the pins 52 each have a head, which has a greater diameter than the rest of the pin 52 and at an end oriented toward the driver flange 50, have a conical contact surface 104 tapering in the axial direction 36 and a contact surface 104*a* extending parallel to the supporting surface 56.

The driver a flange 50 constitutes an axial supporting surface 56 for the cutting wheel 16, establishes an axial position of the cutting wheel 16, and has openings 58 let into it in the vicinity of the pins 52. In addition, three axial through bores 60 are let into the driver flange 50, which are evenly distributed over the circumference in the circumference direction 32, 34.

The driver disk 40 that is movably supported on the drive shaft 18 has three bolts 30 press-fitted into it one after the other in the circumference direction 32, 34, which extend in the axial direction 38 toward the cutting wheel 16 and, with a part 24, protrude up from the driver disk 40 in the axial direction 36 oriented away from the cutting wheel 16. The helical spring 28 presses the driver disk 40 in the direction 38 toward the cutting wheel 16, against the driver flange 50 and the driver disk is supported against this driver flange. The bolts 30 protrude through the through bores 60 and extend up from the driver flange 50 in the axial direction 38.

In addition, disposed in the center on the side oriented toward the cutting wheel 16, the driver mechanism 12 has a cup-shaped unlocking button, which is of one piece with the actuating button 22 of a locking device 20 of the drive shaft 18. The unlocking button has three segments 62, which are distributed evenly in the circumference direction 32, 34, extending in the axial direction 36 in relation to the movably supported driver disk 40 and which reach through corresponding recesses 64 of the driver flange 50 and are secured against falling out in the axial direction by means of a snap ring 66 inside the driver disk 40. The unlocking button is guided so that it can move in the axial direction 36, 38 in an annular recess 68 in the driver flange 50.

Figure 3:
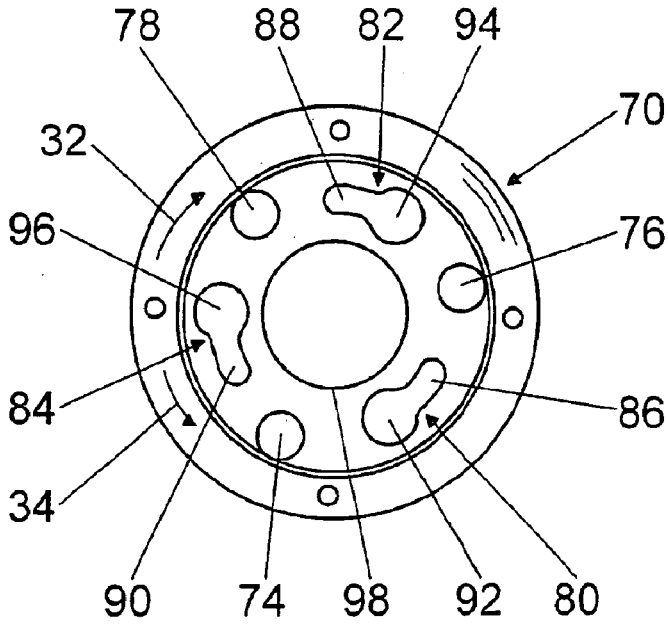
FIG. 3 shows a bottom view of a tool hub.

The cutting wheel 16 has a sheet metal hub 70, which is securely connected to and pressed onto a grinding device 72 by means of a riveted connection that is not shown in detail (FIG. 3). The tool hub could also be made of another material deemed appropriate by one skilled in the art, for example plastic, etc. The sheet metal hub 70 has bores 74, 76, 78 in succession, distributed evenly in the circumference direction 32, 34, whose diameter is slightly greater than the diameter of the bolts 30. In addition, the sheet metal hub 70 has three oblong holes 80, 82, 84 distributed evenly in the circumference direction 32, 34 and extending in the circumference direction 32, 34, each of which has a narrow region 86, 88, 90 and a wide region 92, 94, 96 produced by means of a bore, whose diameter is slightly greater than the diameter of the heads of the pins 52.

The sheet metal hub 70 has a centering bore 98, whose diameter is advantageously chosen so that the cutting wheel 16 can also be clamped by means of a conventional clamping system to a clamping flange and a spindle nut on a conventional right angle grinding machine. A so-called backward compatibility is assured.

When the cutting wheel 16 is installed, the cutting wheel 16 is slid with its centering bore 98 onto a collar 54 formed onto the supporting surface 56 of the driver flange 50, which radially centers the cutting wheel 16 with its centering bore 98. The driver flange 50 can thus advantageously absorb radial forces produced during operation without putting strain on the unlocking button 22.

Then the cutting wheel 16 is rotated until the pins 52 engage in the provided wide regions 92, 94, 96 of the oblong holes 80, 82, 84 of the sheet metal hub 70. The sheet metal hub 70 pressing against the supporting surface 56 of the driver flange 50 causes the bolts 30 to be slid into the through bores 60 and causes the driver disk 40 to be slid axially counter to a spring force of the helical spring 28 on the drive shaft 18, in the direction 36 oriented away from the cutting wheel 16. The parts 24 of the bolts 30, which protrude up from the driver disk 40 in the axial direction 36 oriented away from the cutting wheel 16, are each slid into one of a number of pockets 26, which are distributed in the circumference direction 32, 34 and are formed into a bearing cover 100. The bearing cover 100 is screwed firmly into the transmission housing 46. The pockets 26 cannot rotate in relation to a rotation axis of the drive shaft 18 or in relation to the drive shaft 18 itself and are closed in the rotation direction, and the drive shaft 18 is form-fittingly locked in the circumference direction 32, 34 by means of the driver flange 50 and the bolts 30.

In the direction of the driver mechanism 12, in a pocket 26 of the bearing cover 100, a sensor 10 is disposed so that it cannot rotate in relation to a rotation axis of the drive shaft 18 and can detect an installation and removal of the cutting wheel 16. When the bolt 30 is inserted into the pocket 26, the bolt 30 actuates an electrical switch element 14 that constitutes the sensor 10. A signal is produced, which interrupts a power supply of the right angle grinder and reliably prevents the right angle grinder or of the driver mechanism 12 from operating.

The pockets 26 are embodied so that they are open radially toward the inside, which can prevent them from becoming clogged with dirt and dust. The pockets 26 could also be advantageously embodied so that they are open in the axial direction 36 oriented away from the cutting wheel 16.

A further rotation of the sheet metal hub 70 counter to the drive direction 34 causes the pins 52 to be slid into the arc-shaped narrow regions 86, 88, 90 of the oblong holes 80, 82, 84. As a result, the pins 52 are slid by means of the conical contact surfaces 104 axially in the direction 38 counter to the force of the disk springs 102 until the contact surfaces 104*a* of the pins 52 overlap the edges of the oblong holes 80, 82, 84 in the arc-shaped narrow regions 86, 88, 90.

When assembled, the disk springs 102, by means of the contact surfaces 104*a* of the pins 52, press the cutting wheel 16 against the supporting surface 56. In lieu of several disk springs 102, the pins can also be loaded by means of other spring elements deemed appropriate by one skilled in the art, such as helical springs or a disk spring, not shown, which extends over the entire circumference. The exemplary embodiment with the pins 52 supported so that they can move axially, is particularly suited for thick tool hubs and/or tool hubs, which can only be elastically deformed slightly.

In an end position or in an achieved operating position of the cutting wheel 16, the bores 74, 76, 78 in the sheet metal hub 70 come to rest over the through bores 60 of the driver flange 50. Due to the spring force of the helical spring 28, the bolts 30 slide out of the pockets 26, in the axial direction 38 toward the cutting wheel 16, engage in the bores 74, 76, 78 of the sheet metal hub 70, and fix this hub in a form-fitting manner in both circumference directions 32, 34. When they engage, an engagement sound is produced, which is audible to the operator and indicates that the tool is ready for operation. Furthermore, when the bolt 30 comes out of the pocket 26, the electrical switch element 14 constituting the sensor 10 is actuated and the power supply of the right angle grinder is switched back on.

A driving torque of the electric motor of the right angle grinding machine can be transmitted from the drive shaft 18 to the driver flange 50 in a frictionally engaging manner and can be transmitted from the driver flange 50 to the cutting wheel 16 in a form-fitting manner by means of the bolts 30. Furthermore, a braking moment, which is directed counter to a driving torque during and after the electric motor being switched off, can be transmitted in a form-fitting manner from the driver flange 50 to the cutting wheel 16 by means of the bolts 30. An unintentional detachment of the cutting wheel 16 is reliably prevented. The three bolts 30 distributed evenly in the circumference direction 32, 34 achieve an advantageous, uniform distribution of force and mass.

In order to detach the cutting wheel 16 from the right angle grinding machine, the unlocking button is pressed. The driver disk 40 is then slid together with the bolts 30 by means of the unlocking button or actuating button 22, counter to the helical spring 28, in the axial direction 36 oriented away from the cutting wheel 16, as a result of which the bolts 30 move in the axial direction 36 out of their locked position and out of the bores 74, 76, 78 of the sheet metal hub 70. At the same time, the bolts 30 engage with their parts 24 in the pockets 26, as a result of which the drive shaft 18 is form-fittingly locked in the rotation direction 32, 34. As with the installation of the cutting wheel, when the bolt 30 is inserted into the pocket 26, the electrical switch element 14 constituting the sensor 10 is actuated by the bolt 30. A signal is produced, which interrupts the power supply to the right angle grinder and reliably prevents an operation of the right ankle grinder or of the driver mechanism 12.

Then the cutting wheel 16 is rotated in the driving direction 34 until the pins 52 come to rest in the wide regions 92, 94, 96 of the oblong holes 80, 82, 84 and the cutting wheel 16 can be removed from the driver flange 50 in the axial direction 38. After the unlocking button is released, the helical spring 28 slides the driver disk 40, the bolts 30, and the unlocking button or actuating button 22 back into their initial positions. When the bolt 30 comes out of the pocket 26, the electrical switch element 14 constituting the sensor 10 is actuated and the power supply of the right angle grinder is switched back on.

| Reference Numerals | |
|---|---|
| 10 | sensor |
| 12 | driver mechanism |
| 14 | switch element |
| 16 | inserted tool |
| 18 | drive shaft |
| 20 | locking device |
| 22 | actuating button |
| 24 | part |
| 26 | part |
| 28 | spring element |
| 30 | detent element |
| 32 | circumference direction |
| 34 | circumference direction |
| 36 | direction |
| 38 | direction |
| 40 | component |
| 42 | housing |
| 44 | handle |
| 46 | transmission housing |
| 48 | handle |
| 50 | driver flange |
| 52 | pin |
| 54 | collar |
| 56 | supporting surface |
| 58 | opening |
| 60 | through bore |
| 62 | segment |
| 64 | recess |
| 66 | snap ring |
| 68 | recess |
| 70 | sheet metal hub |
| 72 | grinding device |
| 74 | bore |
| 76 | bore |
| 78 | bore |
| 80 | oblong hole |
| 82 | oblong hole |
| 84 | oblong hole |
| 86 | region |
| 88 | region |
| 90 | region |
| 92 | region |
| 94 | region |
| 96 | region |
| 98 | centering bore |
| 100 | bearing cover |
| 102 | disk spring |
| 104 | supporting surface |

What is claimed is:

1. A hand power tool, with a driver mechanism (12), which can operatively connect an inserted tool (16) to a drive shaft (18), characterized in that at least one electrical sensor (10) can detect at least one procedural step in the changing of an inserted tool (16) and can produce a signal, and the signal can prevent an operation of the driver mechanism (12).

2. The hand power tool according to claim 1, characterized that the signal can switch off a power supply.

3. The hand power tool according to claim 1, characterized in that the drive shaft (18) can be locked in place by means of an actuating button (22) of locking device (20) in order to change the inserted tool (16) and that the sensor (10) can detect a position of the actuating button (22).

4. A hand power tool, with a driver mechanism (12), which can operatively connect an inserted tool (16) to a drive shaft (18), characterized in that at least one sensor (10) can detect at least one procedural step in the changing of an inserted tool (16) and can produce a signal, and the signal can switch a light source.

5. A hand power tool, with a driver mechanism (12), which can operatively connect an inserted tool (16) to a drive shaft (18), characterized in that at least one sensor (10) can detect at least one procedural step in the changing of an inserted tool (16) and can produce a signal, and the inserted tool (16) can be operatively connected to the driver mechanism (12) by means of at least one detent element (30), which is supported so that it can move in opposition to a spring element (28), engages in an operating position of the inserted tool (16), and fixes the inserted tool (16) in a form-fitting manner, and that the sensor (10) can detect at least one position of the detent element (30).

6. The hand power tool according to claim 5, characterized in that the detent element (30) can be moved in the axial direction (36) in opposition to the spring element (28).

7. The hand power tool according to claim 5, characterized in that the detent element (30) can actuate an electrical switch element (14) that constitutes the sensor (10).

8. The hand power tool according to claim 7, characterized in that the switch element (14) is disposed so that it cannot rotate in relation to a rotation axis of the drive shaft (18).

9. A hand power tool, with a driver mechanism (12), which can operatively connect an inserted tool (16) to a drive shaft (18), characterized in that at least one sensor (10) can detect at least one procedural step in the changing of an inserted tool (16) and can produce a signal, the drive shaft (18) can be locked in a piece by means of an actuating button (22) of a locking device (20) in order to change the inserted tool (16) and that the sensor (10) can detect a position of the actuating button (22), the actuating button (22) is operatively connected to the drive shaft (18) in the rotation direction (32, 34) and the actuating button (22) for locking the drive shaft (18) can connect at least one first part (24). which is operatively connected to the drive shaft (18) in the rotation direction, to a second part (26) that cannot rotate in relation to a rotation axis of the drive shaft (18).

* * * * *